US009121279B2

(12) United States Patent
Creighton et al.

(10) Patent No.: US 9,121,279 B2
(45) Date of Patent: Sep. 1, 2015

(54) TUNABLE TRANSITION DUCT SIDE SEALS IN A GAS TURBINE ENGINE

(75) Inventors: Sherman Craig Creighton, West Palm Beach, FL (US); Charles Ellis, Stuart, FL (US); David John Henriquez, Hobe Sound, FL (US); Peter Stuttaford, Jupiter, FL (US)

(73) Assignee: Alstom Technology Ltd, Baden (CH)

( * ) Notice: Subject to any disclaimer, the term of this patent is extended or adjusted under 35 U.S.C. 154(b) by 1240 days.

(21) Appl. No.: 12/901,084

(22) Filed: Oct. 8, 2010

(65) Prior Publication Data

US 2012/0085099 A1 Apr. 12, 2012

(51) Int. Cl.

| | |
|---|---|
| ***F23R 3/02*** | (2006.01) |
| ***F23R 3/26*** | (2006.01) |
| ***F01D 9/02*** | (2006.01) |
| *F01D 11/00* | (2006.01) |

(52) U.S. Cl.

CPC . *F01D 9/023* (2013.01); *F23R 3/26* (2013.01); *F01D 11/005* (2013.01); *F23R 3/02* (2013.01); *F23R 2900/00012* (2013.01)

(58) Field of Classification Search

CPC ..... F01D 9/023; F01D 11/005; F23R 3/002; F23R 3/02

USPC ..... 60/746, 747, 752–760, 782, 785; 277/644, 637, 630

See application file for complete search history.

(56) References Cited

U.S. PATENT DOCUMENTS

| | | | | |
|---|---|---|---|---|
| 4,719,748 | A | 1/1988 | Davis, Jr. et al. | |
| 6,209,325 | B1 * | 4/2001 | Alkabie | 60/737 |
| 6,345,494 | B1 | 2/2002 | Coslow | |
| 6,412,268 | B1 | 7/2002 | Cromer et al. | |
| 6,450,762 | B1 * | 9/2002 | Munshi | 415/138 |
| 6,675,584 | B1 * | 1/2004 | Hollis et al. | 60/796 |
| 6,745,571 | B2 * | 6/2004 | Stuttaford et al. | 60/772 |
| 6,792,763 | B2 | 9/2004 | Sileo et al. | |
| 6,834,507 | B2 | 12/2004 | Jorgensen | |
| 7,178,340 | B2 | 2/2007 | Jorgensen | |
| 7,481,037 | B2 * | 1/2009 | Takaya et al. | 60/39.37 |
| 7,527,472 | B2 | 5/2009 | Allen | |
| 7,788,932 | B2 * | 9/2010 | Kunitake et al. | 60/797 |
| 8,186,167 | B2 * | 5/2012 | Chila et al. | 60/752 |
| 8,245,515 | B2 * | 8/2012 | Davis et al. | 60/752 |
| 8,562,000 | B2 * | 10/2013 | Moehrle et al. | 277/644 |
| 2002/0121744 | A1 * | 9/2002 | Aksit et al. | 277/411 |
| 2005/0166599 | A1 * | 8/2005 | Terazaki et al. | 60/785 |
| 2007/0175220 | A1 * | 8/2007 | Bland | 60/751 |
| 2009/0072497 | A1 * | 3/2009 | Kunitake et al. | 277/641 |
| 2009/0145099 | A1 * | 6/2009 | Jennings et al. | 60/39.37 |
| 2009/0188258 | A1 * | 7/2009 | Rizkalla et al. | 60/800 |
| 2009/0324387 | A1 * | 12/2009 | Turaga | 415/115 |
| 2010/0061837 | A1 * | 3/2010 | Zborovsky et al. | 415/58.4 |
| 2012/0280460 | A1 * | 11/2012 | Cihlar et al. | 277/637 |

* cited by examiner

*Primary Examiner* — Phutthiwat Wongwian
*Assistant Examiner* — Rene Ford
(74) *Attorney, Agent, or Firm* — Shook, Hardy & Bacon L.L.P.

(57) ABSTRACT

A system and method for tuning a gas turbine combustion system having a plurality of seals positioned between the combustion system and the turbine inlet is disclosed. The system and method provide ways of permitting a predetermined amount of compressed air to bypass the combustion system and enter the turbine so as to control emissions and dynamics of the combustion system. The seals contain a plurality of holes to meter airflow passing therethrough and are positioned such that they can be removed from the engine and modified to increase or decrease the amount of air passing therethrough.

5 Claims, 5 Drawing Sheets

TUNABLE TRANSITION DUCT SIDE SEALS IN A GAS TURBINE ENGINE

CROSS-REFERENCE TO RELATED APPLICATIONS

Not applicable.

TECHNICAL FIELD

The present invention generally relates to gas turbine engines. More particularly, embodiments of the present invention relate to a combustion system and a method of operation of the combustion system in order to provide an additional way of controlling engine emissions and combustion dynamics.

BACKGROUND OF THE INVENTION

Gas turbine engines operate to produce mechanical work or thrust. For land-based gas turbine engines, a generator is typically coupled to the shaft, such that the mechanical work produced is harnessed to generate electricity. A typical gas turbine engine comprises a compressor, at least one combustor, and a turbine, with the compressor and turbine coupled together through an axial shaft. In operation, air passes through the compressor, where the pressure of the air increases and then passes to a combustion section, where fuel is mixed with the compressed air in one or more combustion chambers. The hot combustion gases then pass into the turbine and drive the turbine. As the turbine rotates, the compressor turns, since they are coupled together along a common shaft. The turning of the shaft also drives the generator for electrical applications. The gas turbine engine also must operate within the confines of the environmental regulations for the area in which the engine is located. As a result, more advanced combustion systems have been developed to more efficiently mix fuel and air so as to provide more complete combustion, which results in lower emissions.

Low emissions combustion systems require the fuel and air being mixed to be properly proportioned in order to obtain optimal results. Fuel flows are usually tightly controlled through carefully sized orifices in the fuel nozzles and controlled fuel valves. Airflows may actually vary due to distributions driven by the compressor exit profile and the amount of air required to cool the turbine section. Because the amount of air introduced into the combustion system significantly affects reaction zone temperature and performance of the combustion system, an adjustable air mass is advantageous for regulating the combustion process.

A general issue with gas turbines, and especially industrial gas turbines, is the need to be able to tune the combustors to avoid issues such as lean blow out (LBO), where the combustor is operating too lean and is not receiving enough fuel, for a given amount of air, causing the flame to be extinguished. Another known problem of tuning a gas turbine combustor include excessive combustion dynamics caused by rapid changes in pressures within the combustor.

To compensate and control these combustion instabilities, prior gas turbine combustors incorporated additional dilution holes in the combustion liner or a transition piece in order to control the amount of air being used in the combustion process. However, these forms of "air control" have been known to adversely effect emissions of the combustion system, at least with respect to carbon monoxide.

SUMMARY

Embodiments of the present invention are directed towards a system and method for, among other things, tuning a gas turbine engine to avoid operational and emissions issues found in prior art designs.

In one embodiment of the present invention, a gas turbine combustion system comprises a combustion liner, a flow sleeve encompassing the combustion liner, an end cap positioned near an end of the combustion liner and the flow sleeve. A plurality of fuel nozzles extend through the cap and towards the combustion liner. A transition duct couples the aft end of the combustion liner to an inlet of the turbine in order to direct the flow of hot combustion gases from the combustor to the turbine. A plurality of tunable side seals are positioned between adjacent transition ducts and the inlet of the turbine. The plurality of side seals each have one or more openings located therein that permit a controlled amount of air to pass therethrough and bypass the combustion system.

In an alternate embodiment, a method of tuning a combustion system of a gas turbine engine is disclosed. A portion of an airflow source to be supplied to the combustion system is determined and then, a size and quantity of openings for a plurality of seals is determined in which the size and quantity will result in the portion of an airflow source being supplied to the combustion system by permitting the remainder of the airflow source to bypass the combustion system. Once the size and quantity of openings are determined, the openings are placed in the plurality of seals and the seals are then placed in the gas turbine engine to regulate the amount of airflow permitted to bypass the combustion system.

In yet another alternate embodiment, a tunable side seal for use in a gas turbine combustor is disclosed wherein the seal comprises one or more sheets of material secured together having one or more holes located through the one or more sheets. The seal is sized and configured to be positioned between sidewalls of adjacent transition ducts and a turbine inlet. Furthermore, the seals are oriented in a manner so as to be accessible from outside of a gas turbine engine such that the seal can be removed and the one or more holes altered to adjust the amount of air permitted to pass therethrough.

Additional advantages and features of the present invention will be set forth in part in a description which follows, and in part will become apparent to those skilled in the art upon examination of the following, or may be learned from practice of the invention.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 1:
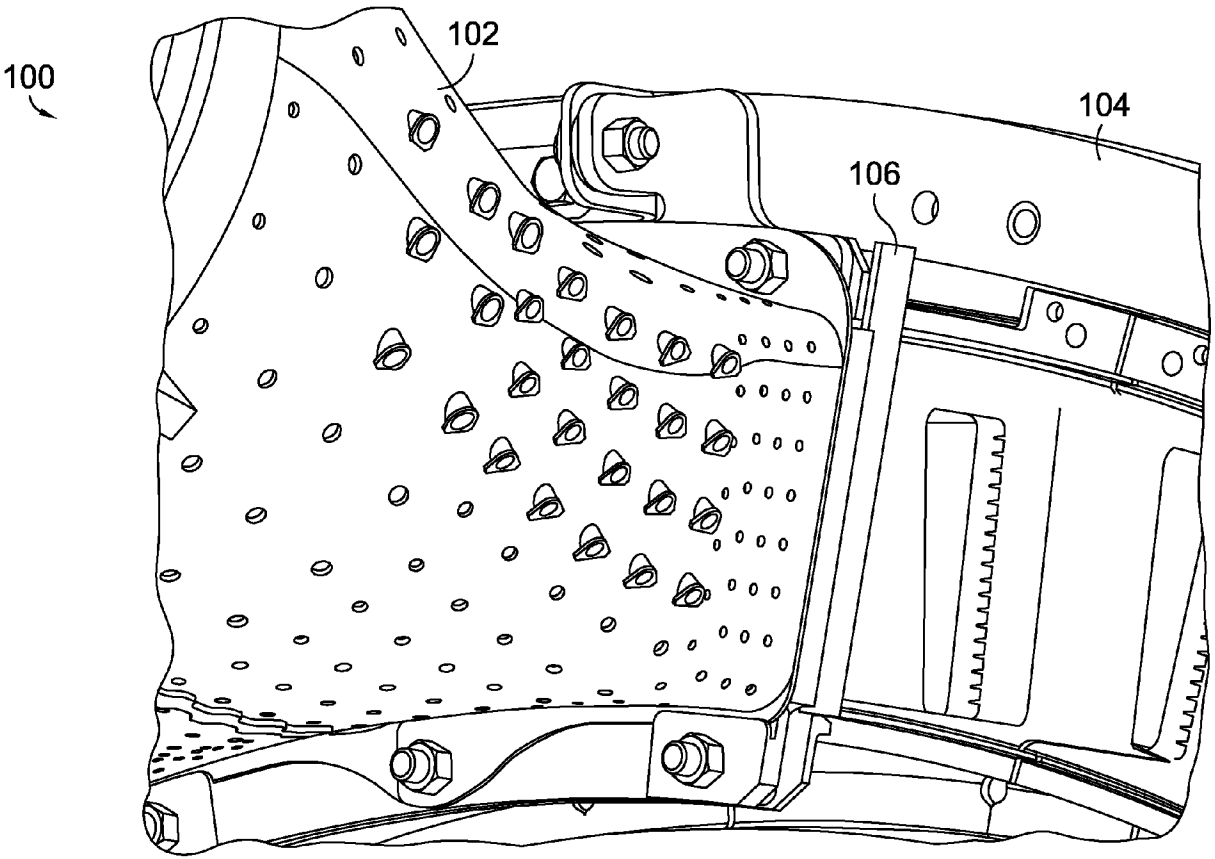
FIG. 1. PRIOR ART
FIG. 1 depicts a perspective view of a portion of a gas turbine engine of the prior art.

Referring initially to FIG. 1, a view of a portion of a combustion system 100 of the prior art is disclosed. The combustion system 100 includes a plurality of combustion liners (not shown) with each liner coupled to a transition duct 102 and the transition duct 102 is in turn coupled to the turbine inlet 104. Transition ducts 102 direct the flow of hot combustion gases from a combustion liner to the turbine inlet 104. Prior art combustors attempted to direct all of the air from the compressor (except for that used for turbine cooling) to the combustion system 100 for maximum efficiency by placing solid seals 106 between adjacent transition ducts 102 and the turbine inlet 106. As previously disclosed, a gas turbine operator or manufacturer could place or adjust size and location of dilution holes in the combustion liner or transition duct 102 in an effort to tailor the airflow to the combustion system. However, such efforts affected the combustion system emissions as well as the temperature profile entering the turbine. Furthermore, the use of solid seals 106 has also resulted in too much air being provided to the combustion system, resulting in an overly lean fuel-air mixture.

Figure 2:
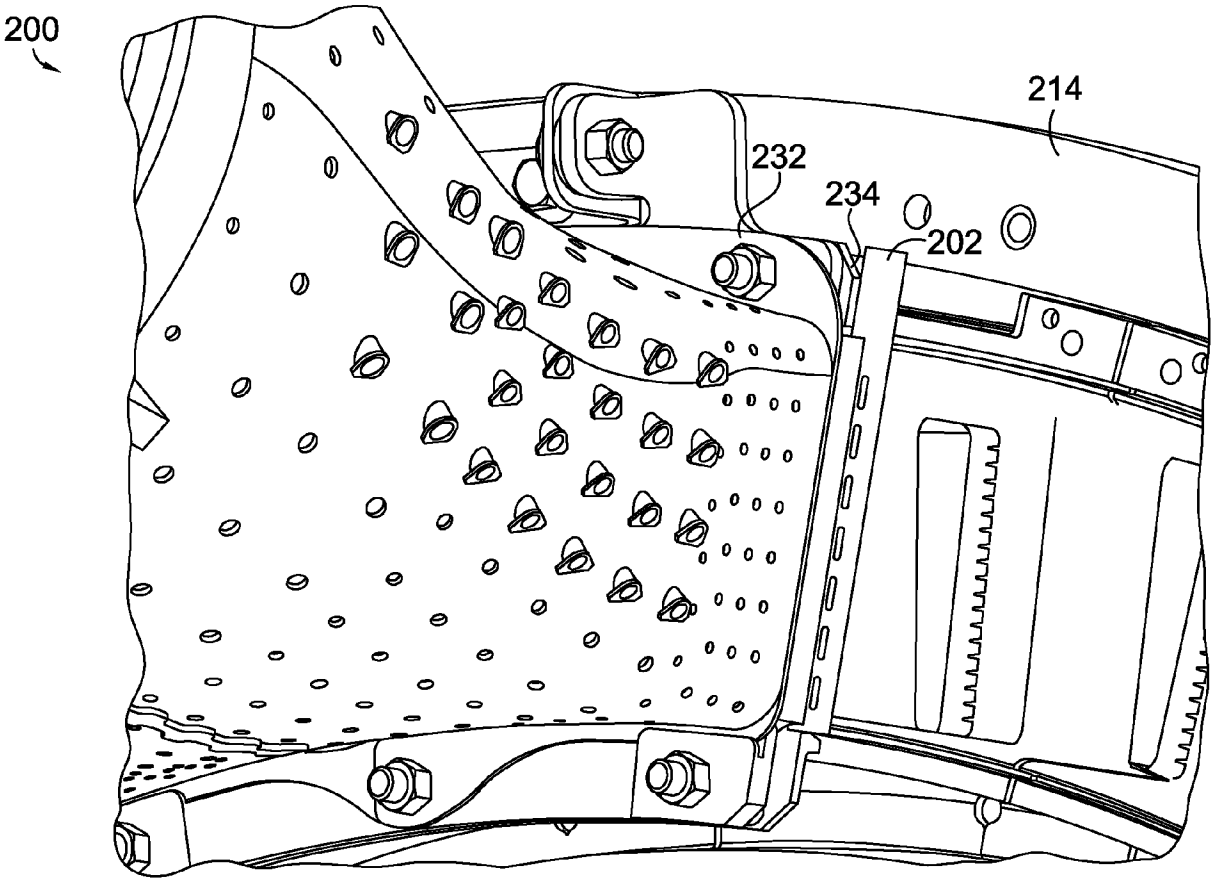
FIG. 2 depicts a perspective view of a portion of a gas turbine engine in accordance with an embodiment of the present invention.
Figure 3:
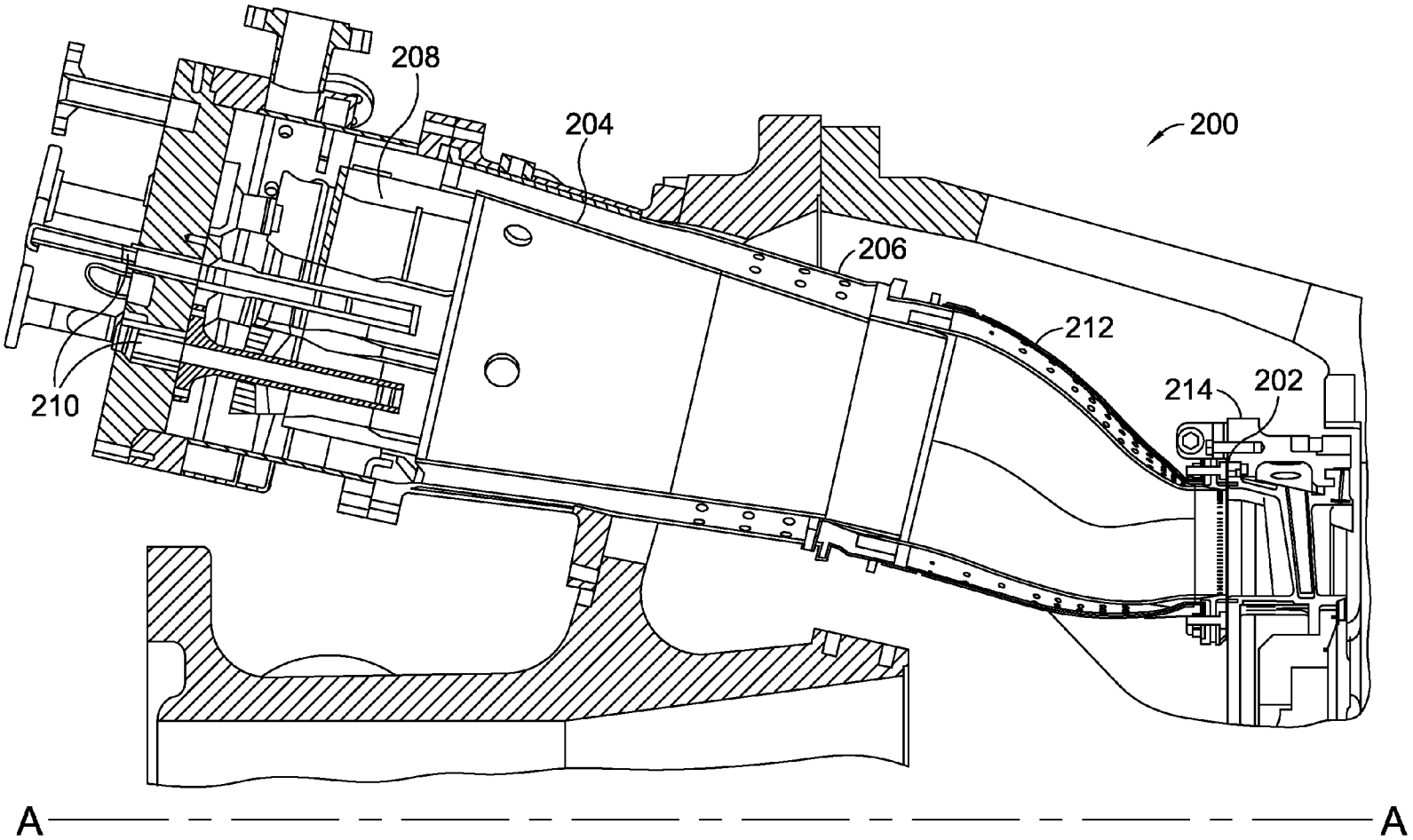
FIG. 3 depicts a cross section of a gas turbine engine in accordance with an embodiment of the present invention.
Figure 4:
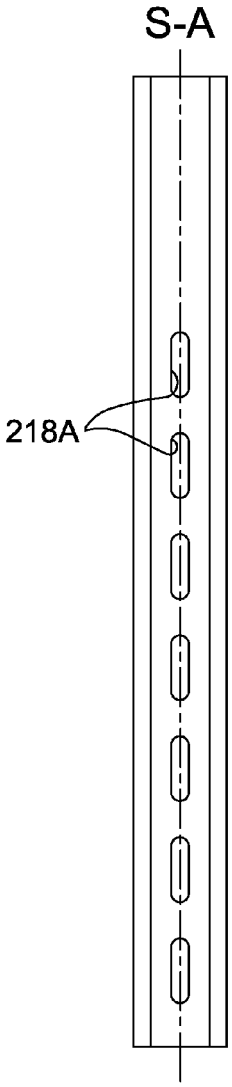
FIG. 4 depicts an elevation view of a seal used in an embodiment of the present invention.

Referring to FIGS. 2-7, multiple embodiments of the present invention are shown. FIG. 2 depicts a portion of a gas turbine combustion system 200 having a tunable side seal 202, where the seal 202 is shown in greater detail in FIGS. 4-6. Referring to FIG. 3, a tunable gas turbine combustion system 200 comprises a combustion liner 204, a flow sleeve 206 encompassing the combustion liner 204 and an end cap 208 positioned proximate a forward end of the combustion liner 204 and flow sleeve 206. A plurality of fuel nozzles 210 extend through openings in the end cap 208 with the fuel nozzles 210 extending towards the combustion liner 204. Coupled to the aft end of the combustion liner 204 is a transition duct 212 that directs the hot combustion gases from the combustion liner 204 into a turbine inlet 214. In the embodiment shown in FIG. 3, a double-walled transition duct is utilized. Referring to FIGS. 3 and 4, a plurality of tunable side seals 202 are located adjacent to the transition duct 204 and have one or more openings 218 located therein. The openings 218A aid in tuning the combustion system 200 by permitting a predetermined amount of air to pass therethrough. As a result of the openings 218A, a controlled portion of air bypasses the combustion system 200, including the combustion liner 204 and transition duct 212. Directing a predetermined amount of air through the side seals 202 provides the operator with a way of tuning the combustion system 200 by setting a quantity and size of openings 218A which will regulate the amount of air directed to the combustion system 200.

The combustion system 200 is generally a can-annular system where there are a plurality of individual combustion systems arranged about a centerline or longitudinal axis of a gas turbine engine as shown in FIG. 3. Each combustion liner 204 and transition duct 212 feed hot combustion gases into a portion of the turbine inlet 214. As a result of the combustion system orientation, the plurality of side seals 202 are oriented generally radially outward relative to the centerline A-A, as shown in FIG. 3. An additional advantage provided by this seal orientation is the ability to remove the plurality of side seals 202 from the combustion system 200. This allows for the one or more openings 218A to be altered in size and/or quantity if an operator determines the amount of air passing therethrough, and bypassing the combustion system 200, is either too much or too little. Openings 218A can be welded closed should there be too much air passing therethrough, or the size of the openings can be increased if the air flow is too little. For example, a plurality of side seals 202 can be used to regulate the amount of air permitted to bypass the combustion system compatible with a General Electric Frame 7FA gas turbine engine. The seal arrangement for this type of combustion system generally permits up to approximately 2% of air from the compressor to bypass the combustion system and pass directly into the turbine. The present invention is not limited to this engine, but instead can be used on a variety of engine types and the total amount of air permitted to pass therethrough can vary.

The plurality of side seals 202 can be fabricated from a variety of materials and sizes depending upon the size and shape of slots between the transition duct 212 and turbine inlet 214 and the operating conditions. Because of the elevated operating temperatures, the plurality of seals 202 are generally fabricated from a high temperature cobalt-based alloy such as Haynes 188. In an embodiment of the invention, the plurality of seals 202 are each generally fabricated from sheet metal, including an embodiment in which a plurality of sheets of metal are fixed together by brazing or a series of spot welds, such that the seal is flexible along the seal axis (S-A), as shown in FIG. 4. Due to the seal construction, the openings should be placed in areas absent of a weld or braze material so as to not initiate cracks in the joints between sheets of metal forming the seal.

In an embodiment of the present invention, a tunable side seal 202 in a gas turbine combustion system is disclosed. The tunable side seal 202 is fabricated from one or more sheets of material 220 having one or more openings or holes located through the one or more sheets. As an example, the side seal 202 can be fabricated from a cobalt-based alloy. The tunable side seal 202 is sized to be positioned between sidewalls (e.g. 232 and 234 of FIG. 2) of adjacent transition ducts 212 and the turbine inlet 214, as shown in FIG. 4. The exact size of the seals and their thickness depends on the configuration of the slot. However, slightly undersizing the thickness of the seal 202 compared to the slot will aid in permitting the seal 202 to be removed.

Where a seal 202 is fabricated from a plurality of sheets of metal that are fixed together along a seal centerline SC, the seal is flexible about its centerline. This flexibility also aids in the installation and removal of the seals 202 when the openings are to be adjusted.

Figure 5:
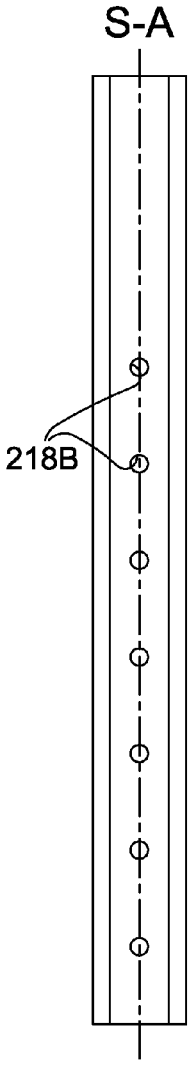
FIG. 5 depicts an elevation view of an alternate seal in an embodiment of the present invention.
Figure 6:
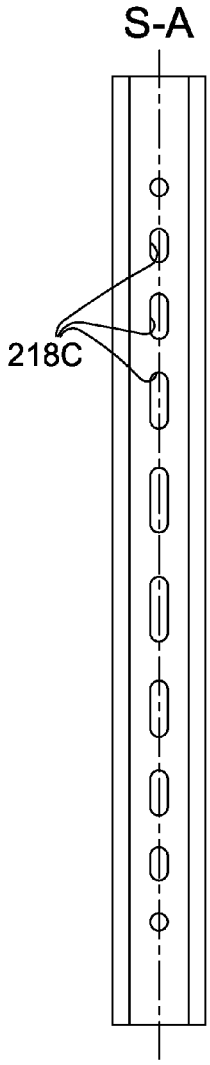
FIG. 6 depicts an elevation view of yet another seal in an embodiment of the present invention; and, FIG. 7 is a chart identifying a method of tuning a combustion system of a gas turbine engine in accordance with an embodiment of the present invention.

As previously discussed, the plurality of seals 202 each has a plurality of openings or holes. The openings can be a variety of shapes and sizes depending upon the amount of air desired to pass through the seal. However, in order to avoid creating non-uniform cooling or "hot-spots" at the turbine inlet 214, it is preferred that the same amount of air pass through each seal around the combustion system. Such a cooling scheme can be created by a uniform set of elliptically-shaped holes 218A as shown in FIG. 4, a set of circular holes 218B as shown in FIG. 5, or a varying pattern of holes 218C across the seal as shown in FIG. 6 as long as the total flow permitted to pass through each seal is generally equal around the turbine inlet 214.

Figure 7:
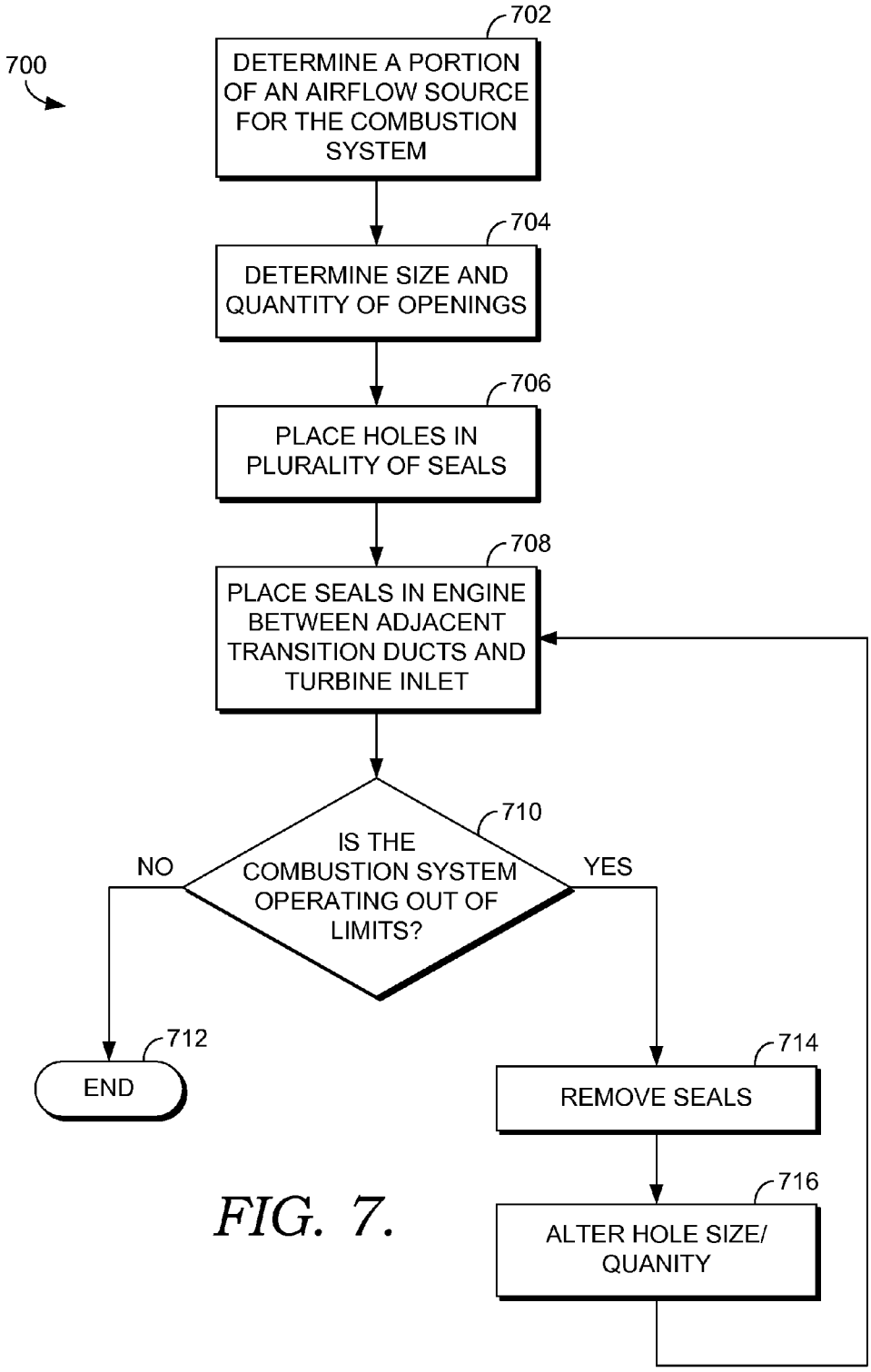

An additional alternate embodiment of the present invention discloses a method 700 of tuning a combustion system of a gas turbine engine, and is shown in FIG. 7. The method 700 comprises a step 702 of determining a portion of an airflow source that is to be supplied to the combustion system. Then, in a step 704, the size and quantity of openings for the plurality of seals that will result in the desired portion of the airflow source to be supplied to the combustion system is determined. Then, in a step 706 the holes are placed in the plurality of seals, and then in a step 708, the plurality of seals having the holes are placed into the gas turbine engine in a region between adjacent transition ducts and an inlet of the turbine. Once the seals are installed in the gas turbine engine and the engine runs, measurements and operational data can be recorded such that, in a step 710, a determination can be made as to whether the combustion system is operating outside of its pre-determined limits. If the combustion system is not operating outside of its limits, then the process ends in a step 712. However, if the determination is made that the combustion system is operating outside of the limits, and a change in air flow is desired, then in a step 714, the seals are removed from the engine, and in a step 716, the quantity and/or size of the openings are adjusted such that the flow of air bypassing the combustion system can be changed. If the airflow is too great, the hole size can be reduced or quantity of holes reduced. If the air flow is too little, the hole size can be increased or quantity of holes can be increased.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A method of tuning a combustion system of a gas turbine engine comprising:

determining a portion of an airflow source to be supplied to the combustion system;

determining a size and quantity of openings for a plurality of seals based on the determined portion that will result in the portion of the airflow source being supplied to the combustion system;

placing the size and quantity of openings in the plurality of seals; and placing the plurality of seals into the gas turbine engine in a region between adjacent double-walled transition ducts and an inlet to the turbine, wherein each of the adjacent double-walled transition ducts comprise a first sidewall and a second sidewall.

2. The method of claim 1 further comprising the step of operating the engine and determining whether the combustion system is receiving the portion of an airflow source.

3. The method of claim 2 further comprising removing the plurality of seals and altering the quantity and/or size of openings in the seal in order to adjust the portion of the airflow source to the combustion system.

4. The method of claim 1, wherein the openings in the plurality of seals are uniform in size.

5. The method of claim 1, wherein the openings in the plurality of seals vary in size across the seal.

* * * * *